United States Patent [19]

Zollweg et al.

[11] 4,126,030

[45] Nov. 21, 1978

[54] RETRACTABLE PRESSURE DIE

[75] Inventors: Richard T. Zollweg, Garden Grove; Homer L. Eaton, Leucadia, both of Calif.

[73] Assignee: Eaton-Leonard Corporation, Santa Ana, Calif.

[21] Appl. No.: 838,496

[22] Filed: Oct. 3, 1977

[51] Int. Cl.[2] ..... B21D 7/04

[52] U.S. Cl. ..... 72/154; 72/155

[58] Field of Search ..... 72/149–159, 72/369

[56] References Cited

U.S. PATENT DOCUMENTS

| | | | |
|---|---|---|---|
| 655,259 | 8/1900 | Miller | 72/159 X |
| 1,662,428 | 3/1928 | Lowe | 72/154 X |
| 1,775,761 | 9/1930 | Harvey et al. | 72/154 X |
| 1,848,753 | 3/1932 | Spate et al. | 72/154 |
| 2,777,500 | 1/1957 | Ekholm et al. | 72/150 |
| 2,974,706 | 3/1961 | DeWitt | 72/154 |
| 3,261,193 | 7/1966 | Van Harten | 72/150 |
| 3,287,952 | 11/1966 | Van Harten | 72/150 |
| 3,352,136 | 11/1967 | Clarke | 72/9 |
| 3,410,125 | 11/1968 | Schmidt | 72/156 |
| 4,009,601 | 3/1977 | Shimizu | 72/150 X |
| 4,063,441 | 12/1977 | Eaton | 72/151 |
| 4,078,411 | 3/1978 | Eaton | 72/154 |

*Primary Examiner*—E. M. Combs

*Attorney, Agent, or Firm*—Gausewitz, Carr & Rothenber

[57] ABSTRACT

In a machine for draw bending pipe, a long pressure die that moves with the pipe during the bend is provided with a retractable rear section. Both sections are used for a large degree of bend but when a bend of lesser degree is made near the end of the pipe, interference between the pipe grasping chuck and the long pressure die is avoided by retracting the rear pressure die section.

13 Claims, 7 Drawing Figures

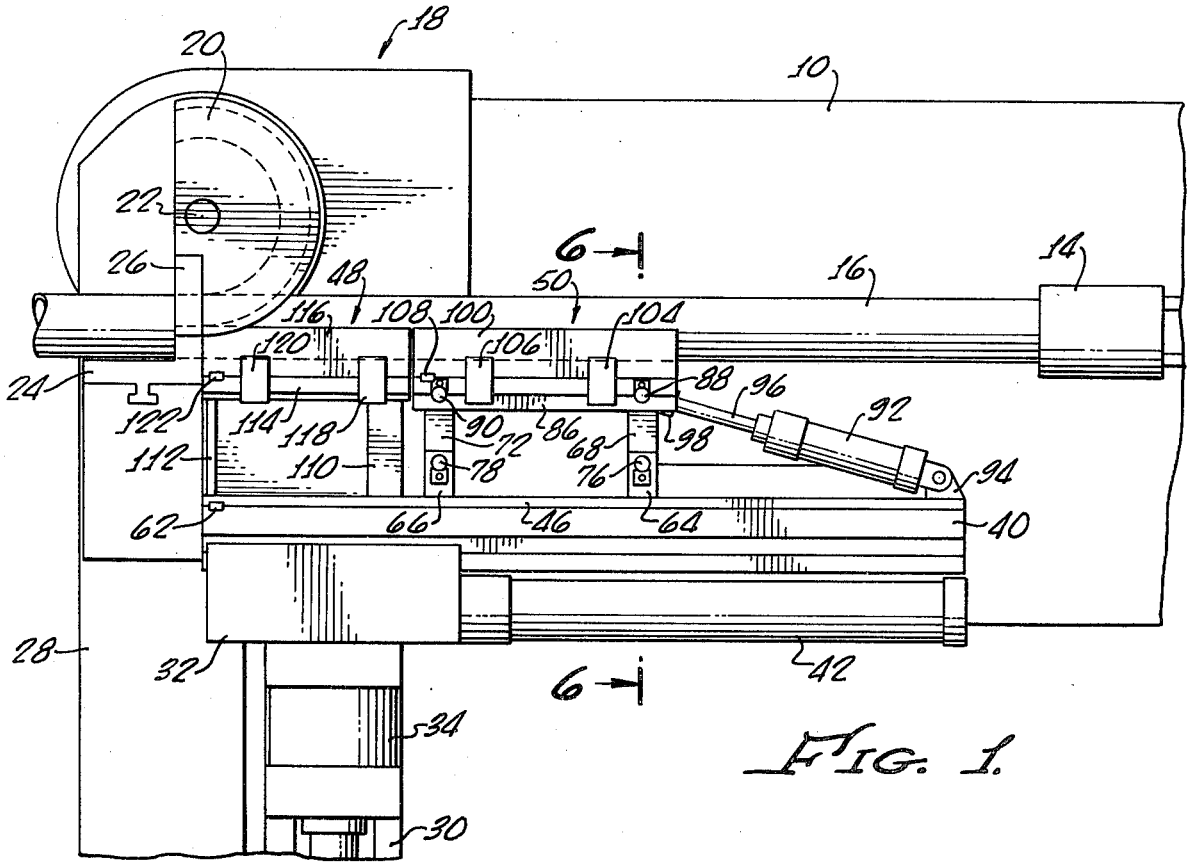
FIG. 1.
FIG. 2.
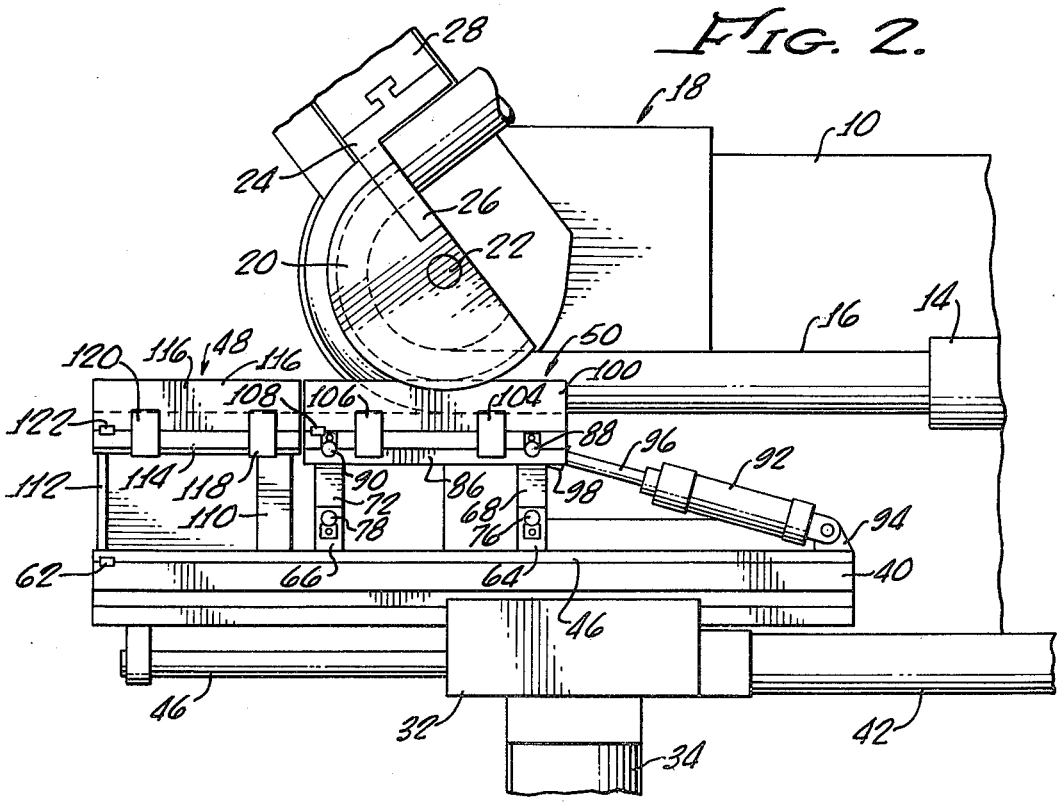

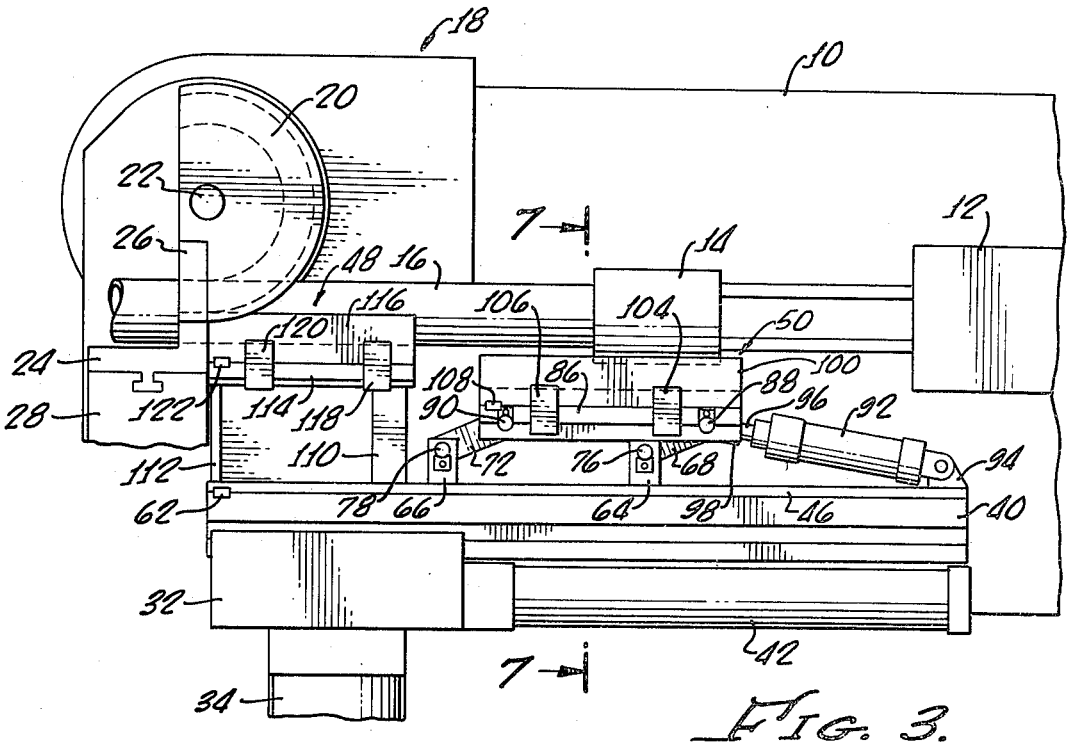
FIG. 3.
FIG. 4.
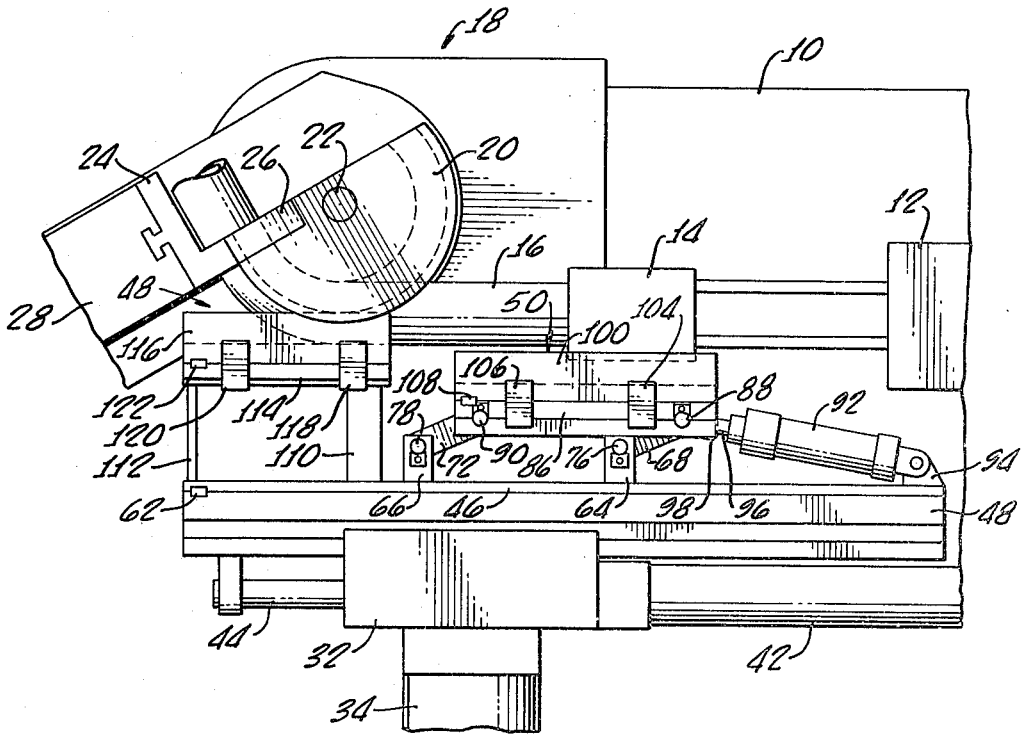

RETRACTABLE PRESSURE DIE

BACKGROUND OF THE INVENTION

The present invention relates to methods and apparatus for bending pipe and more particularly concerns an improved pressure die therefor.

In a commonly used type of apparatus for bending pipe, such as automobile exhaust pipes, for example, a rear section of the pipe is grasped by a chuck which rotates the pipe and moves it longitudinally for positioning relative to a bending head. The bending head comprises a rotatably mounted bend die and an opposed clamp die which clamp a portion of a tube to be bent therebetween, so that upon joint rotation of the clamp and bend dies, the pipe is bent about the bend die. A portion of the pipe immediately to the rear of the bend and clamp dies (toward the chuck) is restrained against lateral motion by a pressure or wiper die.

Where the described apparatus is used for draw bending, a mechanism is provided to longitudinally restrain a portion of the pipe immediately to the rear of the portion being bent, so that during the bend the pipe is stretched, or drawn (e.g., tensioned beyond its yield point). Such restraint may be provided by an internal mandrel, the pressure die, or a combination of the two. To this end the pressure die will press the pipe against the bend die with sufficient force so that friction between the pipe and dies tends to restrain, either completely or partially, the forward motion of the pipe as it is bent and pulled around the rotating bend die. Commonly the pressure die is restrained against forward motion and the pressure exerted thereby against the pipe is controlled so that a wiping action occurs, that is, the pipe is drawn through the mating cavities of the pressure and bend dies against the frictional restraint imposed by the force exerted by the collective action of the pressure and bend dies.

In some draw bending operations, wiping action, where the pipe slides through and between tightly pressing bend and pressure dies, results in unacceptable marring of the pipe and in unacceptable wear upon the dies themselves. To avoid these undesired effects, the pressure die may be caused to move forwardly, together with the pipe, as the latter is bent around the bend die. In such an arrangement little or no motion of the pipe relative to the pressure die will occur, thus eliminating or greatly minimizing the wiping action and its adverse effects. But the forward motion of the pressure die, together with the pipe, still may be so controlled as to cause the pressure die, in conjunction with the opposed bend die, to exert a sufficient restraint upon motion of the pipe as to provide the desired drawing action.

When the pressure die is fixed (does not move with the pipe) to provide a wiping action in rotary draw bending, a relatively short pressure die can be employed and therefore, the pipe grasping chuck may be moved relatively closer to the point of bend. This enables the apparatus to bend the pipe close to the point thereof that is grasped by the chuck. On the other hand, when the pressure die is moved forwardly together with the pipe, a short pressure die can be used only for a small degree of bend. This is so because large bends, such as bends of 180°, for example, require a large amount of forward motion of the pipe and concommitant forward motion of the pressure die. Such large amount of forward motion will cause a short pressure die to move forwardly beyond the bend die so that frictional restraining force can no longer be exerted by the coacting pressure and bend dies. Thus a moving pressure die must be relatively long and is accordingly more likely to tend to interfere with the chuck upon making a final bend in a given pipe.

The U.S. Pat. to Suding, et al., No. 3,553,990 suggests a programmed sequence of operations to avoid such interference between chuck and pressure die. In this patent the apparatus is controlled to sense when such interference is likely to occur, whereupon the apparatus is caused to follow a rather complex sequence of operations which include stopping the carriage, completely withdrawing the entire pressure die, advancing the carriage, clamping the tube to the bend die, releasing the pipe from the chuck, retracting the carriage, moving the pressure die to the pipe, making the bend, advancing the carriage to realign the end of the pipe with the chuck, withdrawing the pressure die, advancing the carriage and chuck, and then again grasping the pipe.

The arrangement of the Suding et al patent requires a complex and time-consuming set of procedures which significantly increase the cost and time of bending. Further, this complex set of relative movements of the several parts, grasping and regrasping the pipe and the chuck, withdrawing the chuck from the pipe and completely withdrawing the pressure die from the pipe, may give rise to increased inaccuracies in positioning and re-positioning of the pipe relative to the various machine components and thus create bending inaccuracy. For example, if another bend is to be made after one bend has been made with the chuck withdrawn from the pipe in the Suding et al apparatus, the bend and clamp dies, together with the pipe, must be rotationally backed up to align the free end of the pipe with the chuck. If this alignment is not precise, the advance of the chuck to the pipe for regrasping the pipe may not be possible and may damage the pipe or the chuck.

Accordingly, it is an object of the present invention to avoid or minimize pressure die interference while decreasing or eliminating above-mentioned problems.

DESCRIPTION OF THE DRAWINGS

FIG. 1 is a fragmentary plan view of a pipe bending machine employing principles of the present invention, showing the parts at the beginning of a long bend;

FIG. 2 is an illustration similar to FIG. 1 showing the parts at the end of a long bend;

FIG. 3 is a view similar to FIG. 1 showing the parts at the start of a short bend with the rear pressure die section retracted;

FIG. 4 is a view similar to FIG. 3 showing the parts at the end of the short bend;

DETAILED DESCRIPTION

Figure 5:
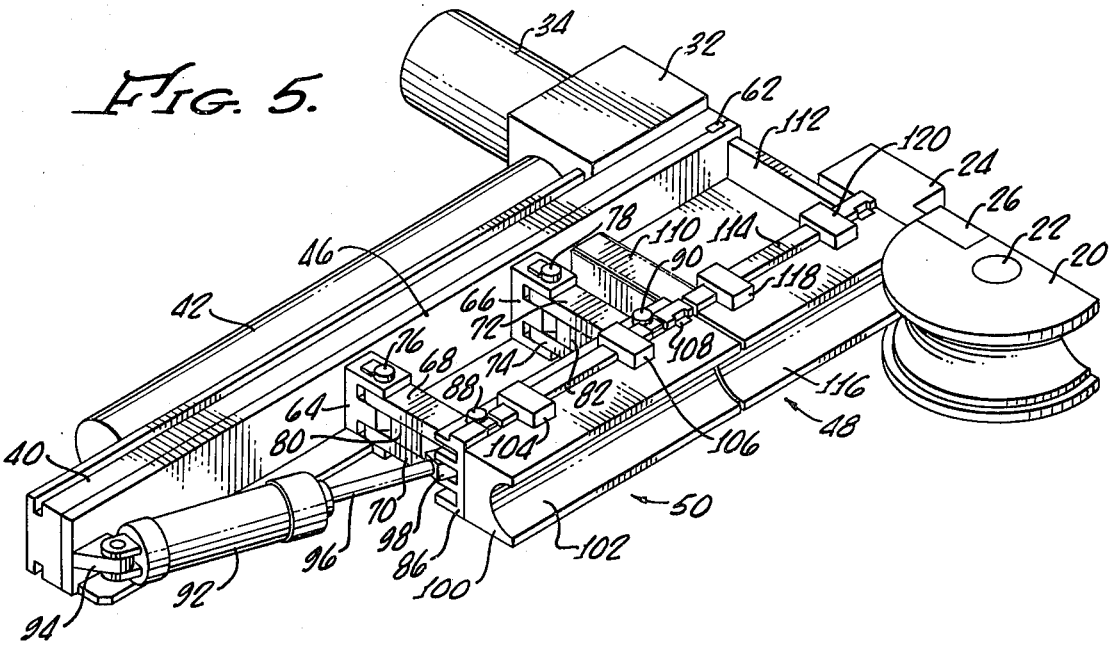
FIG. 5 is a pictorial illustration of the sectional pressure die and related components.

The apparatus to be described herein may be used with many different types of bending machines and, in fact, with most bending machines of the type having a pressure die, a clamp die and a rotary bend die for bending a pipe, whether the bending be compression or draw bending. Further, principles of the invention may readily be applied to still other types of bending machines. Nevertheless, the invention has been initially embodied in rotary bending machines of the type shown in U.S. Pat. No. 3,949,582 for Positioning Servo and Controlled Mechanism, assigned to the assignee of the present application, and in the apparatus described in a co-pending application of Homer L. Eaton, Ser. No. 692,585, filed June 3, 1976, entitled Method and Apparatus for Bending Tube, now U.S. Pat. No. 4,063,441, issued Dec. 20, 1977, also assigned to the assignee of the present application. The disclosure of such co-pending application, and of parent and divisional applications thereof, are incorporated by this reference as though fully set forth herein.

As illustrated in FIG. 1, a typical rotary type bending machine includes a machine bed 10 on which is movably mounted a carriage 12 (FIG. 3) that carries a rotatable chuck 14 for grasping a pipe 16 that is to be bent. The chuck firmly holds an end of the pipe and positions it longitudinally and rotationally with respect to the machine bending head, generally indicated at 18. The bending head includes a bend die 20 mounted for rotation about a vertical axis 22 (where the machine is oriented to make bends in a horizontal plane) and a clamp die 24 cooperating with a fixed insert 26 of the bend die to grasp the pipe 16 which is to be bent about the bend die. The clamp die 24 is mounted for motion radially of the bend die upon a movable bend arm assembly 28 which itself rotates about bend axis 22, carrying both the clamp die 24 and the bend die 20 in a circular path about the bend axis 22. A stationary arm assembly 30 mounts a pressure die bolster 32 for slidable motion in a horizontal direction perpendicular to the axis of the pipe 16, toward and away from the pipe 16, and is urged toward the pipe by means of a pressure die cylinder 34 fixed to the bolster and having a piston fixed to the stationary arm assembly.

Mounted to the bolster 32 for sliding motion in a direction parallel to the axis of the pipe 16 is the pressure die slide 40 that is driven forwardly by means of a pressure die boost cylinder 42 fixed to the bolster 32 and having a piston 44 (not shown) that is fixed to a forward end of the slide 40.

Slide 40 fixedly carries a pressure die bracket 46 which, in turn, mounts forward and rear pressure die sections 48, 50. Each section comprises a die shoe and a supporting platen as will be described more particularly below.

Forward pressure die section 48 is fixedly positioned with respect to the bracket 46 whereas rear pressure die section 50 is retractable, being mounted on the bracket 46 for motion relative to the pipe and relative to the forward pressure die section so as to enable the rear pressure die section to clear the chuck 14 when the latter is moved forwardly. This retraction is from the position shown in FIGS. 1 and 2 to the position shown in FIGS. 3 and 4.

Figure 6:
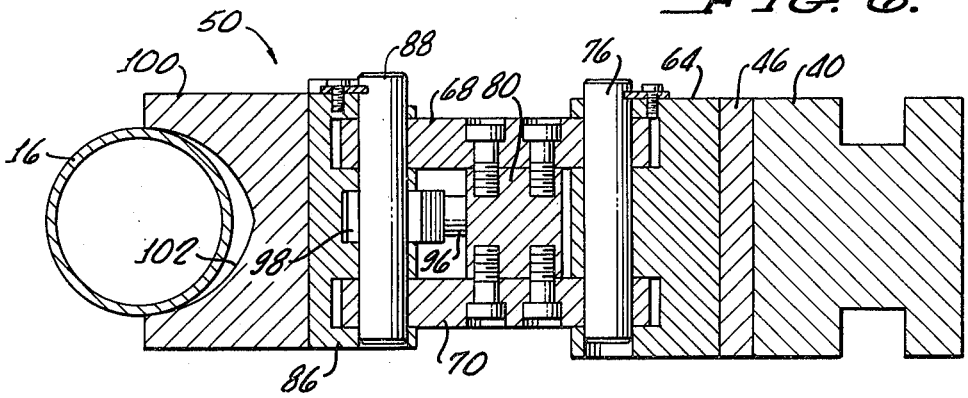
FIG. 6 is a section taken on lines 6—6 of FIG. 1.
Figure 7:
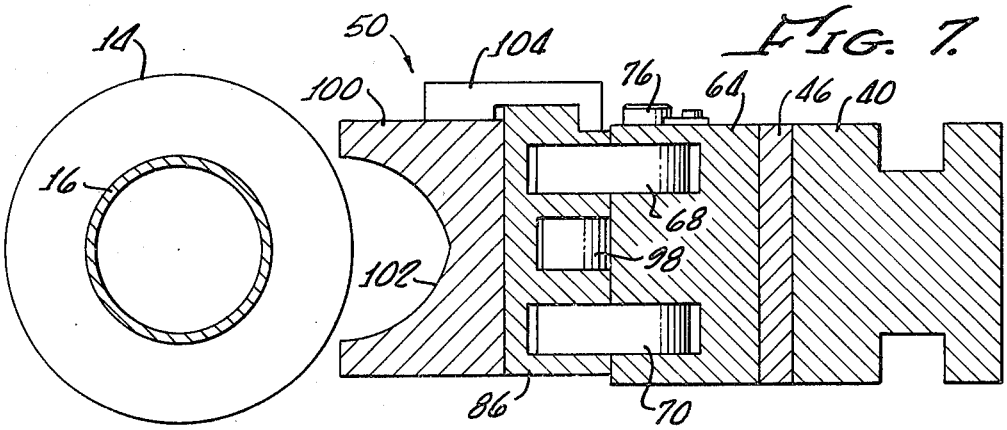
FIG. 7 is a section taken on lines 7—7 of FIG. 3.

All of the dies are formed with pipe receiving die cavities, as can be best seen in FIGS. 5, 6 and 7.

In normal operation, a rearmost end of the pipe 16 is fixedly grasped in the chuck 14 and the carriage, together with the chuck, is moved in the direction of the longitudinal axis of the pipe to position the latter relative to the bending head according to a predetermined bend location. The chuck is also rotatable to rotatably position the pipe for controlling the plane of bend. After positioning the pipe, the clamp die 24 is moved radially inwardly toward the bend die to clamp the pipe against the bend die. The pressure die bolster 32 (and pressure die sections) is likewise moved in a parallel direction, by means of pressure die cylinder 34, to press the pipe between the forward end of the forward die section and the bend die. The carriage brakes are released, but the chuck continues to firmly grasp the pipe. With the parts in the position shown in FIG. 1, the bend and clamp dies are rotated together about the bend die axis, bending the pipe around the bend die and pulling the pipe forwardly as it is bent. The pressure die cylinder 34 maintains a pressure on the bolster forcing the pressure die toward the bend die with the pipe interposed therebetween. Boost cylinder 42 continues to drive the bolster, and thus the entire pressure die assembly, forwardly to move together with the pipe as the latter is drawn around the bend die.

The parts continue to move until the bend is completed. Position of the parts upon completion of a large bend, considerably greater than 180°, is illustrated in FIG. 2 which shows, when compared with FIG. 1, the rotation of the bend and clamp dies and the forward rectilineal motion of the long pressure die assembly. The chuck 14 has been drawn forwardly toward the bend die. In the described operation, the pressure die assembly moves forward together with the pipe and the chuck, of course, is also drawn forwardly with the pipe.

It should be noted that the relatively great length of the pressure die provided by the combined and mutually aligned forward and rear sections 48, 50 is required for the large bend illustrated in FIGS. 1 and 2. This may be seen from inspection of the figures which show in FIG. 1 the forward portion of forward pressure die section 48 juxtaposed to the bend die. This allows the pipe to be pressed between the forward end of the forward pressure die section and the bend die to provide the axial restraint required for elongation of the pipe beyond its yield point. However, as the bending progresses, the pressure die section moves in a linear path that is substantially tangent to the bend die so that upon completion of this long bend, a portion of the rear section toward the back of the rear pressure die section 50 is now opposed to the bend die. Thus, the rear pressure die section is employed to press the pipe against the bend die at the end of the bending movement. If the pressure die were shorter, such as for example if the rear section is entirely omitted, the pressure die would completely move out of its cooperating pressing position with respect to the bend die (in making a long bend) and the axial restraint of bend and pressure dies would thus terminate before the end of the bend had been achieved. Thus, for a long bend, the long pressure die (both forward and rear sections) is needed.

In those cases where the distance between the start of a bend and the front of the chuck is less than the length of the prior art single long pressure die, one must either use the shorter pressure die, completely remove the pressure die, or take some other steps to avoid interference between the pressure die and the chuck. To remove and replace the pressure die is undesirable because of the expense and time involved in making the change in the course of bending of a single pipe. To move the entire pressure die out of the way, results in many difficulties, as set forth above, and furthermore, could result in a misalignment of the pipe. As previously noted, all of the dies are formed with pipe receiving cavities and these cavities help to position and align the pipe. Thus the presence of the pressure die in close proximity to the pipe, with the pipe received or at least partially received within the pressure die cavity, maintains the appropriate position and orientation of the section of the pipe between the bend die and the carriage.

According to the present invention, interference between the chuck and the pressure die is avoided when making a bend close to the point of the pipe grasped by the pressure die by making the pressure die in two or more sections. Thus the rearmost one of the rearmost two or more of the pressure die section is/are retractable to clear the path of the chuck while at least one forward section of the pressure die remains in position, to help support and position the pipe and to maintain it in alignment with the chuck when the rear pressure die section or sections are retracted to clear the path of the chuck. Although more than one individually retractable rear pressure die section may be employed, it is presently preferred to use the two section pressure die illustrated, having but one forward section and one rear section.

For making such a bend that is close to the point of the pipe that is grasped by the chuck, the rear section 50 of the illustrated die is retracted to the position shown in FIG. 3 and, after such retraction has been accomplished, the chuck and pipe are advanced toward the bend head to the position illustrated in FIG. 3 to position the pipe properly with respect to this bend. It will be noted that for the bend illustrated in FIGS. 3 and 4, the distance from the point of bend to the chuck is less than the combined length of the two pressure die section, so that the pressure die would interfere with the chuck as the latter moves to the position in FIG. 3 if the rear pressure die section had not been retracted. The clamp die and forward section of the pressure die are then moved to press the pipe against the bend die just as previously described in connection with the operation of the bend illustrated in connection with FIGS. 1 and 2, and bending is commenced.

All the parts operate just as before, except for the fact that the rear section of the pressure die, which is in its retracted position and remains in such position throughout the bend, does not assume any operative relation with respect to the pipe. It is only the forward section of the pressure die that presses the as yet unbent portion of the pipe against the bend die. In this operation the parts move from the position of FIG. 3 to the position of FIG. 4, the latter illustrating the position of the parts at the completion of a shorter bend made near the end of the pipe.

Although the operation is described with respect to avoidance of interference of a bend made close to the end of a pipe, it will be readily appreciated that some bending apparatus may be arranged to cause the chuck to grasp an intermediate portion of the pipe with a rearward section of the pipe extending through the chuck and rearwardly beyond the carriage. With such an apparatus, it may be still desirable to position the pipe to bend at a distance from the chuck that is less than the full length of the combined forward and rearward sections of the pressure die. In such a situation, the bend would be made with the rear section of the pressure die in the retracted position. Thereafter, if deemed necessary or desirable, the pipe may be moved relative to the chuck to cause the chuck to grasp a more rearward section of the pipe for still further bending.

It will be noted, as can be seen with respect to the operation depicted in FIGS. 3 and 4, that the chuck does not have to, and does not in fact, release its grip upon the pipe at any time prior to or during the bend in which the rear section of the pressure die is retracted. Further, the forward section of the pressure die is always in position to cause its cavity to position and align the pipe. Thus even if it should be desirable to release the grasp of the chuck from the pipe, and even if it should be desirable to withdraw the carriage and chuck from the end of the pipe, when the rear section of the pressure die is retracted, the forward section of the pressure die, which is fixedly positioned relative to the axis of the pipe, will still help to position and align the pipe. Thus upon completion of a bend, the bend die need not be backed up and no computation to determine a precise amount of such back up rotation need be undertaken.

It will be readily appreciated that many types of sectional pressure dies may be employed in carrying out principles of the present invention. Various types of mechanism will retract the rearmost one or more sections of the pressure die in a linear or arcuate path. Of course, various combinations of rectilinear and curved paths of retraction can also be employed. A presently preferred mechanization of a retraction mechanism for the rear pressure die section is illustrated in further detail in FIGS. 5, 6 and 7, wherein the rear pressure die section is shown to be mounted on a pair of spaced linkages, providing a parallelogram linkage under the control of an hydraulic motor which can drive the rear pressure die section to and between either of its limit positions.

Thus, as shown in FIGS. 5, 6 and 7, the flat plate or pressure die bracket 46 is fixedly bolted to the pressure die slide 40 and positioned relative thereto by means of bolts (not shown) and a key 62.

Double slotted lugs 64, 66 are fixed to the bracket 46 and mutually spaced therealong for receiving in the slots thereof pivot links 68, 70 and 72, 74, which are pivoted to the lugs by pivot shafts 76, 78. The links 68, 70 of one pair are fixedly spaced from one another and similarly the links 72, 74 of the other pair are fixedly spaced from one another by means of link spacer blocks 80, 82. The other ends of each of the links 68, 70, 72, 74 are received in slots formed in a slotted rear pressure die platen 86 of the rear pressure die section 50 and are pivoted to the platen by means of pivot shafts 88, 90 that extend through the links and the platen.

A pressure die retracting motor comprises an hydraulic cylinder 92 pivoted at one end to a lug 94 that is fixed to bracket 46 and driving a piston rod 96 that is connected to pivot pin 88 of the link pair 68, 70 by means of a bearing 98. Piston rod 96 of cylinder 92 and the piston affixed thereto are positioned so that when the rod is extended from the cylinder, the piston (not shown) will bottom at the end of the cylinder to provide the limiting position of the rear section of the pressure die as illustrated in FIGS. 1 and 2. In this position the rear pressure die section is directly aligned with the forward pressure die section, and the pipe receiving cavities therein are directly aligned with one another, the two sections being in end-to-end relation with their contiguous ends closely adjacent to one another but slightly spaced.

The limit of the retracted position of the rear pressure die section may be provided by any suitable stop means, which in the illustrated embodiment is afforded by abutment of the end of lug 64 with the facing lateral surface of the pressure die platen 86, as can be seen in FIGS. 3 and 4.

Detachably carried upon the rear pressure die platen 86 is the rear pressure die shoe itself identified by numeral 100, having a pipe receiving pressure die cavity 102, as more particularly described in the above-mentioned application for Method and Apparatus for Bending Tube, Ser. No. 692,585. The pressure die shoe 100 is mounted upon the rear pressure die platen in the manner described in the above-mentioned application. The mounting of the pressure die shoe upon the platen may take any one of a number of desired forms, but as described in such above-identified patent application, comprises a pair of brackets 104, 106 fixed to the pressure die shoe and having slots that are slidably engaged upon an upstanding upper edge of the platen. A key 108 carried by the platen is slidably engaged in a vertically extending groove formed in the back of the pressure die shoe to prevent relative motion of the die shoe with respect to the platen.

The platen of the forward pressure die section 50 is fixedly mounted to the bracket 40 upon fixed posts 110, 112 that are fixed at one end, as by welding or the like, to the bracket 46 and, at the other end, to a forward pressure die platen 114 of the forward pressure die section 48. A forward pressure die shoe 116 fixedly carries brackets 118, 120 that are slotted to slidably engage over the upstanding edge of forward platen 114 and a vertically extending key 122 fixed to the platen is received in a mating vertically extended groove of the pressure die shoe 116 to prevent relative motion of the die with respect to the platen.

Although the described sectional pressure die is designed for use and provides its described advantages where the die moves forwardly during bending, it is also capable of use where the pressure die is fixed.

The foregoing detailed description is to be clearly understood as given by way of illustration and example only, the spirit and scope of this invention being limited solely by the appended claims.

What is claimed is:

1. The method of bending a pipe comprising the steps of grasping a portion of the pipe in a chuck and moving the pipe and chuck to position a forward section of the pipe between a clamp die and a bend die, clamping a forward section of pipe between said clamp and bend dies, rotating the bend and clamp dies together to bend the forward section of the pipe about the bend die, pressing a more rearward section of the pipe toward the bend die by means of a pressure die as the pipe is bent, and moving the pressure die forwardly relative to the bend die as the pipe is bent, said step of pressing the pipe toward the bend die comprising positioning a forward section of said pressure die adjacent one side of said pipe, and moving a rear section of said pressure die relative to said forward section from said one side to clear the path of said chuck so as to allow the chuck to be positioned closer to the bend and clamp dies before completion of a bend without interferring with the pressure die.

2. The method of claim 1 including the step of positioning said pipe by means of said forward pressure die section when said rear pressure die section is moved to clear the path of the chuck.

3. The method of claim 1 comprising rotating said bend and clamp dies while said chuck grasps the pipe.

4. The method of claim 1 including the step of employing said forward pressure die section to maintain the pipe in alignment with the chuck while the rear pressure die section is moved to clear the chuck.

5. The method of claim 1 wherein said rear section is moved while maintaining said forward pressure die section in position to receive said pipe in a pressure die cavity.

6. The method of claim 1 including laterally positioning said pipe by pipe receiving cavities in said dies, and wherein said rear pressure die section is retracted laterally of said pipe to withdraw the rear pressure die section cavity from the pipe.

7. The method of claim 1 wherein said rear pressure die section is moved before said chuck and pipe are moved to position the forward section of the pipe between said bend and clamp dies.

8. The method of claim 1 wherein said rear pressure die section is not moved for making a bend which begins at a point on the pipe spaced a relatively long distance from the chuck and wherein the rear section of the pressure die is retracted for making a bend that begins at a point on the pipe spaced a relatively short distance from the chuck.

9. The method of claim 1 wherein said rearward pressure die section is retracted for making a bend that begins at a distance from said chuck that is less than about the total length of said pressure die.

10. In a pipe bending apparatus wherein a forward section of a pipe is pressed against a bend die by a clamp die, the bend and clamp dies are rotated together to bend the pipe about the bend die, and a rear section of the pipe is pressed toward the bend die by a relatively long pressure die that moves forwardly along the bend die as the pipe is being bent, and in which a rearward section of the pipe to be bent is grasped by a chuck that moves to position the pipe relative to the dies, the improvement wherein said pressure die comprises forward and rear pressure die sections, longitudinally positioned on the same side of the pipe, and means for mounting said rear pressure die section for motion between a first position in operative relation to said pipe, and a second position in which the chuck may move toward the bend die without interference with the rear pressure die section, whereby the chuck may grasp an end of the tube to be bent and may be moved forwardly toward the bend die without interference with the rear pressure die section in its second position to position the pipe for bending at a point thereof relatively close to the chuck.

11. The apparatus of claim 10 wherein said pressure die sections are mounted on a common pressure die slide, and including means for moving said rear pressure die section between said first and second positions.

12. The apparatus of claim 11 wherein said means for mounting said rear pressure die section comprises first and second links, each pivoted to and between said slide and respectively spaced points on said rear section of the pressure die.

13. The apparatus of claim 10 including a pressure die slide, a pressure die bracket fixed to said slide, said forward pressure die section being fixed to and spaced from said pressure die bracket and having a cavity for receiving a pipe to be bent, said rear pressure die section having a pipe receiving cavity aligned with the cavity of said forward pressure die section, and wherein said rear pressure die section is retractable in a plane that is perpendicular to the axis of rotation of the bend die.

* * * * *